US006685171B2

(12) United States Patent
Lob et al.

(10) Patent No.: US 6,685,171 B2
(45) Date of Patent: Feb. 3, 2004

(54) LIFTING DEVICE

(75) Inventors: Charles J. Lob, Oconomowoc, WI (US); John S. Millman, Waukesha, WI (US)

(73) Assignee: Harken, Inc., Pewaukee, WI (US)

( * ) Notice: Subject to any disclaimer, the term of this patent is extended or adjusted under 35 U.S.C. 154(b) by 124 days.

(21) Appl. No.: 09/757,796

(22) Filed: Jan. 10, 2001

(65) Prior Publication Data

US 2003/0071253 A1 Apr. 17, 2003

(51) Int. Cl.[7] ..... B66D 3/04
(52) U.S. Cl. ..... 254/391
(58) Field of Search ..... 254/390, 391, 254/393, 408

(56) References Cited

U.S. PATENT DOCUMENTS

| | | | | | |
|---|---|---|---|---|---|
| 407,592 | A | * | 7/1889 | Harkness | 24/134 KB |
| 670,129 | A | * | 3/1901 | Combs | 24/134 R |
| 723,231 | A | * | 3/1903 | Benedict | 254/391 |
| 903,433 | A | * | 11/1908 | Baker | 188/65.1 |
| 1,067,456 | A | * | 7/1913 | Battey | 24/134 R |
| 1,167,295 | A | * | 1/1916 | Hall | 24/134 KB |
| 1,389,514 | A | * | 8/1921 | Kestell | 254/391 |
| 1,399,182 | A | * | 12/1921 | Benedict | 24/134 KB |
| 1,432,096 | A | * | 10/1922 | Behie | 254/226 |
| 3,112,816 | A | * | 12/1963 | Halford | 254/391 |
| 4,521,000 | A | * | 6/1985 | Dodge, Jr. | 254/391 |
| 5,615,865 | A | * | 4/1997 | Fountain | 254/391 |
| 5,638,919 | A | * | 6/1997 | Pejout | 182/192 |
| 5,738,339 | A | * | 4/1998 | Kuryu | 254/267 |
| 5,845,894 | A | * | 12/1998 | Petzl et al. | 254/391 |
| 5,860,493 | A | * | 1/1999 | Cherpitel | 188/65.2 |
| 6,182,946 | B1 | * | 2/2001 | Rutherford | 254/391 |
| 6,234,454 | B1 | * | 5/2001 | Vassioukevitch | 254/391 |

* cited by examiner

*Primary Examiner*—Emmanuel Marcelo
(74) *Attorney, Agent, or Firm*—Pyle & Piontek

(57) ABSTRACT

A lifting device comprises a rotatable pawl with a pawl arm held in a pawl sleeve. The pawl has an open position in which a rope may be freely adjusted in tightening or loosening directions, and a closed position in which the rope is lockably engaged between the pawl and the pawl sleeve. The pawl has a pawl arm against which the locked rope may be directed to rotate the pawl into an open position. The lifting device also includes a pulley for mechanical advantage, and a base for mounting to a surface. A preferred embodiment of the lifting device of the invention comprises a plurality of pulleys for additional mechanical advantage, and is pivotally attached to an overhead surface.

3 Claims, 7 Drawing Sheets

LIFTING DEVICE

FIELD OF THE INVENTION

The present invention relates to a lifting device for holding and locking rope under tension. More particularly, the present invention relates to a lifting device having a self locking feature upon release of a first end of a line, so that a load on the second end of the line will not be freed, except by operation of the first end of the line when placed under tension.

BACKGROUND OF THE INVENTION

Cam cleats for releasably clamping and holding ropes are well known in the art, with prior art patents dating back over a century. For particular rope holding and adjusting applications, however, even the populous prior art has left various problems unresolved.

Cam cleats are widely used on sailing vessels and the like, and generally comprise one or more spring loaded pawls which serve to releasably lock a line or rope in one direction, namely the direction of the load on the line. The free end of the line can be pulled manually through the cam jaws or pawls, and the line is locked when tension is released on the free end of the line. The line can be disengaged only by manually lifting the line out of engagement with the pawl. It is also generally known to provide a retaining member above the pawls to constrain the line after it has been released, which facilitates re-engagement of the line with the cam. Many examples of known cam cleats are described in the 1999 Harken Yacht Fittings catalog published by Harken, Inc., Pewaukee, Wis.

Cam cleats having a lever arm on one of the cams are also known. The free end of the line can be deflected against the lever arm to release the associated cam.

Notwithstanding past development, however, there presently exists a need for a fail safe device for raising and lowering heavy objects. As an example, for storage in the ceiling space of a garage.

The present invention solves these and other problems that remain otherwise heretofore unresolved.

OBJECTS OF THE INVENTION

It is an object of the invention to provide a lifting device having a mechanical advantage and a releasable cleat to enable fail safe raising and lowering of objects.

SUMMARY OF THE INVENTION

The present invention generally comprises a lifting device for mounting on a surface, the lifting device having an adjustable cleat and at least one pulley. A rigid frame member connects the pulley and the cleat to one another, as well as to a base, which is connected to a surface. The adjustable cleat of the lifting device has a rope engaging surface and a movable pawl. The movable pawl has a rope locking surface and a pawl arm, with the rope locking surface opposite the cleat rope engaging surface. A rope is releasably locked in place between the rope locking surface and the rope engaging surface when the movable pawl is in a closed position. The pawl may be moved into and out of locking engagement with the rope by manipulation of the pawl arm. The pulley has a sheave rotatable about a central hub, with the central hub connected to the frame member. The rope passes from the adjustable cleat and over the pulley sheave.

In operation, the rope may be urged against the pawl arm to disengage the cleat, thereby releasing the rope for adjustment. Once the rope is no longer urged against the pawl arm, a spring means urges the pawl back into a closed position, thereby locking the rope in place once again.

In a first example embodiment of the lifting device of the invention, the adjustable cleat of the lifting device of the invention comprises a rotatable pawl mounted within a U-shaped sleeve. The closed end wall of the U-shaped sleeve comprises the cleat rope engaging surface. The rotatable pawl is held between the opposing arms of the open end of the U-shaped sleeve, with the pawl rope locking surface opposite the rope engaging surface. The rope may thereby be locked in place within the sleeve. When the pawl is disengaged by urging the rope against the pawl arm, the rope is freed for adjustment through the sleeve, but remains captive within the sleeve. The pawl is preferably spring loaded and urged towards a closed position, so that upon release of the rope the pawl will move to a closed position thereby releasably locking the rope in place.

In additional embodiments of the lifting device of the invention, a plurality of pulleys are present to provide increased lifting power. An auxiliary pulley is connected to a load to be lifted. The rope may be reeved through the pulleys to provide various ratios of lifting power.

The base of the lifting device of the invention may be mounted to a vertical surface, such as a wall, or to an overhead surface such as a ceiling. In an example embodiment of the lifting device of the invention, the base comprises a hanging bail and is pivotally connected to an overhead surface. This allows for rotation of the frame holding the pulleys and pawl so as to find its static balance point under operation. Also, this allows for a user vertically below the lifting device to be located a horizontal distance away so as to not be below a suspended load.

The above brief description sets forth rather broadly the more important features of the present disclosure so that the detailed description that follows may be better understood, and so that the present contributions to the art may be better appreciated. There are, of course, additional features of the disclosure that will be described hereinafter which will form the subject matter of the claims appended hereto. In this respect, before explaining a preferred embodiment of the disclosure in detail, it is to be understood that the disclosure is not limited in its application to the details of the construction and the arrangements set forth in the following description or illustrated in the drawings. The present invention is capable of other embodiments, of being practiced and carried out in various ways, as will be appreciated by those skilled in the art. In addition, it is to be understood that the phraseology and terminology employed herein are for description and not limitation.

DETAILED DESCRIPTION

Figure 1:
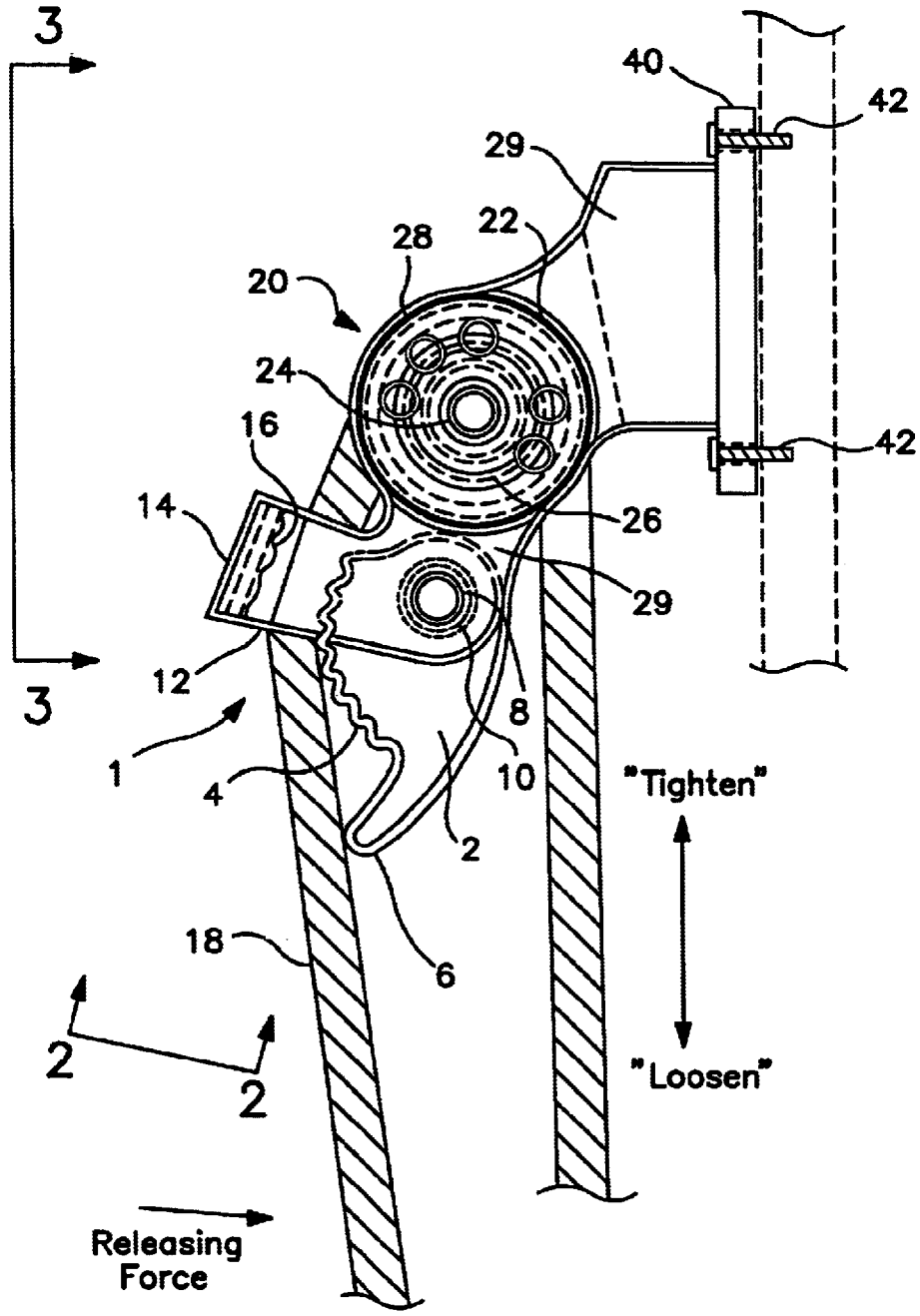
FIG. 1 is a side view, partially in cross section, of a first example embodiment of the lifting device of the invention, with the pawl in the open position.
Figure 4:
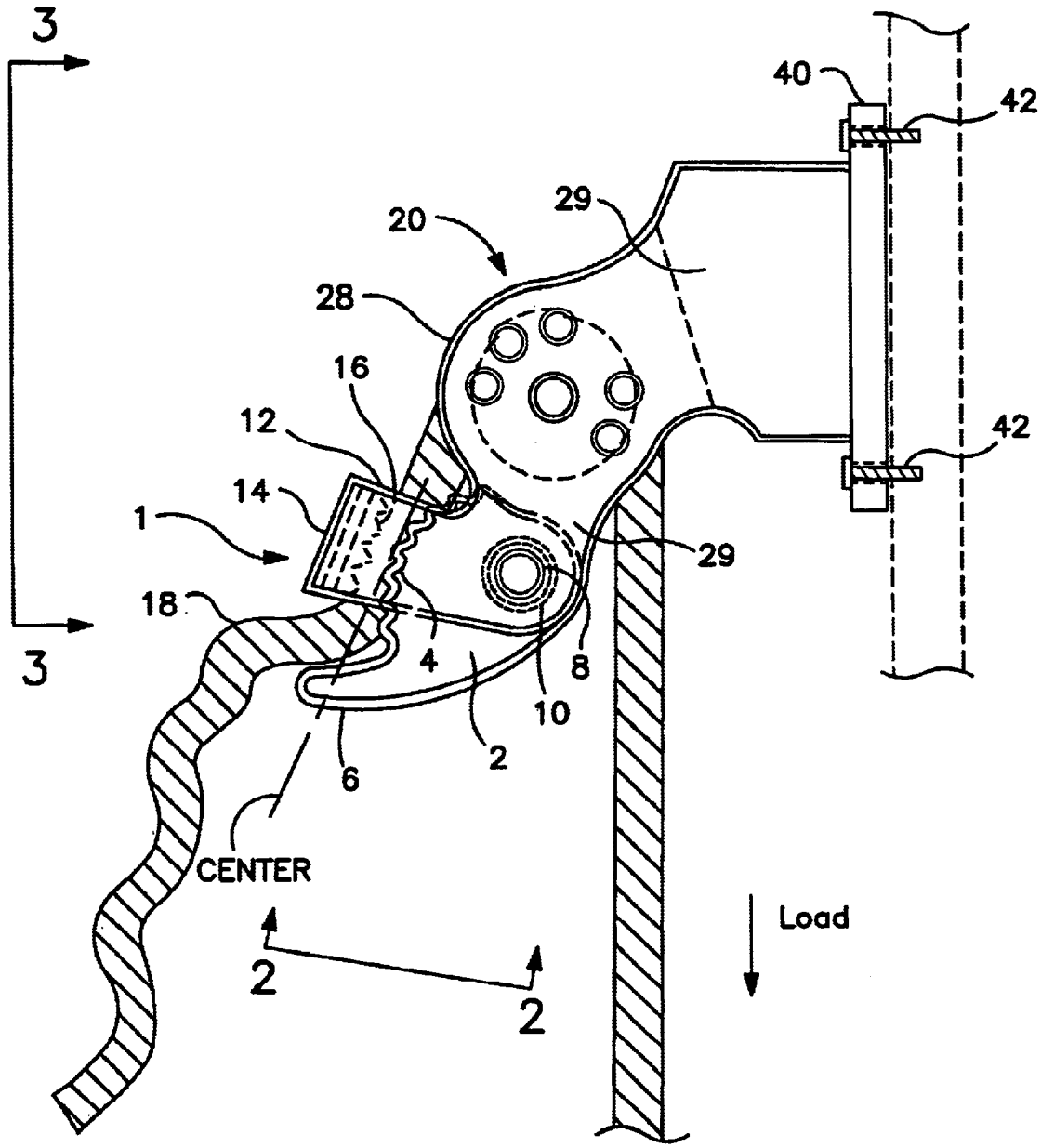
FIG. 4 is a side view, partially in cross section, of the same embodiment of the lifting device illustrated in FIG. 1, with the pawl in the closed position.

Turning now to the drawings, FIG. 1 is a side view of a first example embodiment of the lifting device of the invention. The preferred lifting device generally comprises adjustable cleat 1, pulley 20, and base 40 connected to one another by frame member 29. Adjustable cleat 1 comprises rotatable pawl 2 with rope locking surface 4 and arm 6. Pawl 2 is rotatable about a pawl hub 8. As used herein, "rotatable" is not intended to be limited to full 360° rotation, but instead to also include partial rotation. Indeed, preferred pawl 2 is "rotatable" only along a partial circumference of pawl hub 8. A torsion spring 10 preferably operates between pawl 2 and hub 8 to urge pawl 2 into a closed position, as illustrated in FIG. 4 (pawl 2 is illustrated in FIG. 1 in an open position).

Figure 2:
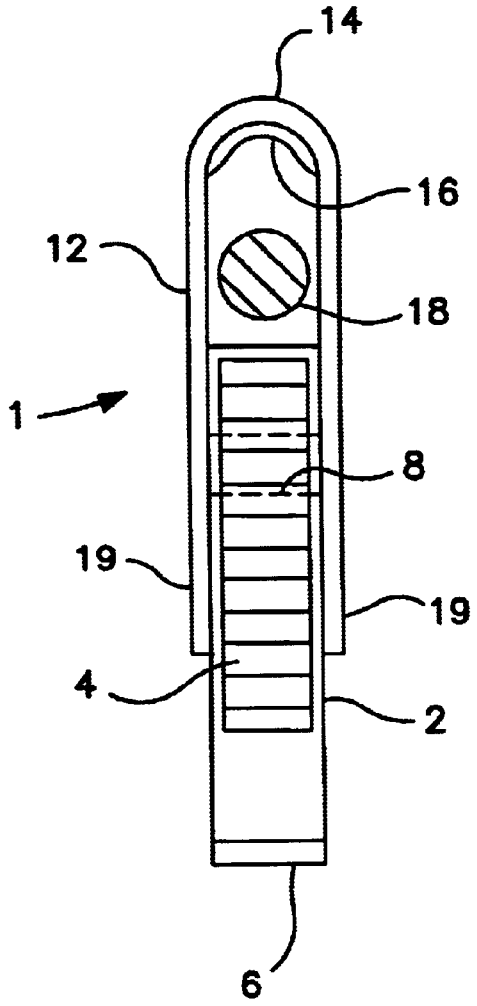
FIG. 2 is an end view of the pawl and pawl sleeve of FIG. 1, viewed along the line 2—2 of FIG. 1.

Pawl 2 is mounted within pawl sleeve 12, having an endwall 14 with an inside rope engaging surface 16. Preferred rope engaging surface 16 has a plurality of locking ridges to increase gripping power. Pawl rope locking surface 4 faces sleeve rope engaging surface 16, with a rope 18 passing through a gap therebetween. As best seen in FIG. 2, pawl sleeve 12 is substantially U-shaped. Sleeve end wall 14 is represented by the closed end of the U-shape, with the interior arc of the closed U-shape end wall comprising sleeve rope engaging surface 16. Pawl 2 is rotatably mounted within the opposite, open end of the U-shape between opposing sleeve end members 19.

It is noted that FIG. 2 is illustrated with pawl 2 rotated to an open position, with the gap between pawl locking surface 4 and sleeve engaging surface 16 larger than rope 18 diameter so that rope 18 may pass freely. The preferred pawl 2 of the invention thus advantageously allows for locking of rope 18 in place with only a single moving member, providing for savings in manufacturing and assembly costs.

Referring once again to FIG. 1, rope 18 passes from pawl sleeve 12 to pulley 20. In operation, pawl 2 and sleeve 12 are "upstream" of pulley 20, with rope 18 having a "free end" closer to pawl 2, and an opposite end attached to a load nearer to pulley 20. Pulley 20 provides significant mechanical advantage to the lifting device of the invention. Preferred pulley 20 comprises sheave 22 rotatable about central hub 24, with a plurality of ball bearings 26 rotatably engaged between hub 24 and sheave 22. As best seen in the end view of FIG. 3, pulley 20 further comprises opposing side cheeks 28, which are connected by frame member 29 to pawl sleeve 12. Most preferably, frame member 29 is integral with pawl sleeve 12 and side cheeks 28. (It is noted that rope 18 has been omitted from the view of FIG. 3.)

As used herein "integral" is intended to refer to a condition of being a single, unitary construction, as opposed to separate parts connected by connectors or the like. As an example, should side cheeks 28 and pawl sleeve 12 be comprised of metal, they may be made integral by welding, or by being molded as a single part. Likewise if the respective elements should be comprised of a moldable polymer such as a thermoplastic, they may be made integral with one another if, for example, they are formed together in a single mold.

Other embodiments of the lifting device of the invention, however, may comprise a frame member 29 that is not integral with adjustable cleat 1 or pulley 20. Indeed, as will be appreciated by those knowledgeable in the art, the invention as claimed may include, by way of example, embodiments of the lifting device that may comprise an adjustable cleat mounted on a frame in sequence with a pulley having only a sheave and central hub (i.e. without side cheeks).

As illustrated in FIG. 4, when pawl 2 is rotated into a closed position, locking surface 4 moves towards engaging surface 16 thereby decreasing the size of the gap therebetween. Preferably, the size of this gap becomes smaller than the diameter of rope 18 in the closed position, with rope 18 thereby firmly gripped and locked in place between the respective surfaces. This will occur, for instance, as a load pulls downward on rope 18 in the direction of the "LOAD" arrow of FIG. 4. To urge pawl 6 into an "open" position, rope 18 is engaged against pawl arm 6, as has been illustrated in FIG. 1, with the "RELEASING FORCE" arrow indicating the direction of the required force.

As rope 18 engages pawl arm 6 in this direction, pawl 2 is disengaged from rope 18 with pawl locking surface 4 moving away from sleeve engaging surface 16. Once in this open position, rope 18 may be adjusted in either a downward or upward direction (i.e. tightening or loosening as indicated by the arrow of FIG. 1). This may be accomplished by pulling rope 18 in the direction of RELEASING FORCE, and then tightening or loosening while orienting rope 18 in the direction of RELEASING FORCE so it passes over pawl arm 6. Thus the lifting device of the present invention may be operated with a single hand, with either tightening or loosening possible. This is an important advantage over cam cleats of the prior art, many of which do not allow for two way adjustment.

Should the rope be released, either intentionally or accidentally, pawl 2 will quickly rotate back to the closed position of FIG. 4 under the urging of spring 10, as well as friction of rope 18 on rope locking surface 4. This provides for fail safe operation, as accidental release of rope 18 free end will not result in a load on the opposite end of rope 18 being dropped.

In this closed position, pawl arm 6 preferably extends substantially across a longitudinal sleeve 12 centerline axis (shown as dashed line "CENTER" in FIG. 4) when rope 18 is held between locking surface 4 and engaging surface 16. The centerline in FIG. 4 is intended to illustrate the approximate longitudinal center line of the gap between locking surface 4 and engaging surface 16 when pawl 4 is in a closed position. Considered in a different manner, the longitudinal centerline axis illustrated in FIG. 1 may comprise the longitudinal centerline axis of the portion of rope 18 that is removably locked in place between the respective surfaces when in the closed position. Such pawl arm 6 orientation advantageously provides for ease of urging pawl arm 6 into an open position when desired.

Figure 3:
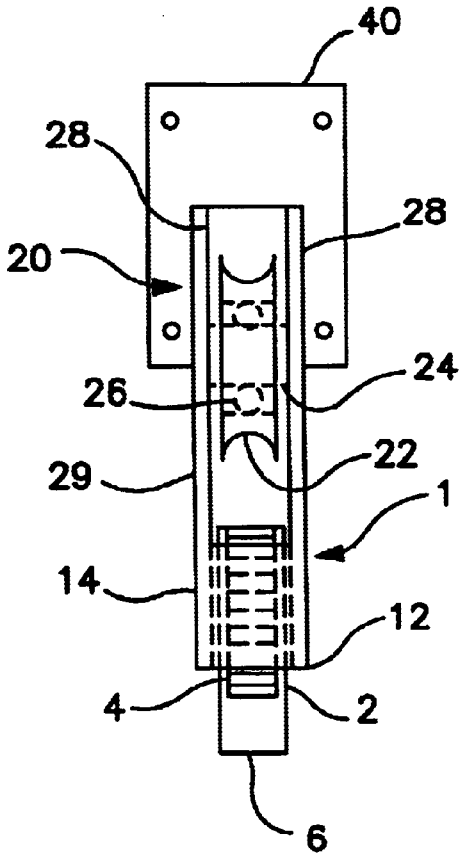
FIG. 3 is an end view, partially in cross section, of the embodiment of FIGS. 1 and 2 viewed along the line 3—3.

Referring once again to FIG. 1, the preferred lifting device of the invention further comprises base 40 for attachment to a surface, such as a vertical wall (illustrated in dashed line in FIGS. 1 and 4). Base 40 is connected to adjustable cleat 1 and pulley 20 by frame member 29. Preferably, base 40 is integral with frame 29, pulley side cheeks 28, and pawl sleeve 12. Base 40 has apertures through it for attaching to the vertical surface by use of screws 42. As illustrated in FIGS. 1 and 3, base 40 is substantially flat with a plane of orientation that is substantially parallel to a central axis of rotation of pulley 20. As will be appreciated by those knowledgeable in the art, frame member 29 may be comprised simply of base 40, pulley side cheeks 28, and pawl sleeve 12. That is, frame member 29 as illustrated in FIGS. 1 and 4 is more or less of a backbone connecting these elements. However, the elements may be constructed and oriented in such a manner that they are essentially connected to one another, in which case the "frame member" of the invention may be thought of as the connecting points between elements.

When mounted on a vertical surface such as a wall, pawl 2 is preferably located spaced farther horizontally from the vertical surface than pulley 20, and located below pulley 20. It has been discovered that such an orientation provides for advantageous use of the lifting device of the invention in many applications, including by way of example for raising loads to be stored along a wall. It is to be understood, however, that the lifting device of the present invention is not limited to such an orientation. Indeed, other embodiments of the lifting device of the invention may orient the base so that the lifting device can be mounted to an overhead surface such as a ceiling, or an underlying surface such as a floor or boat deck.

Figure 5:
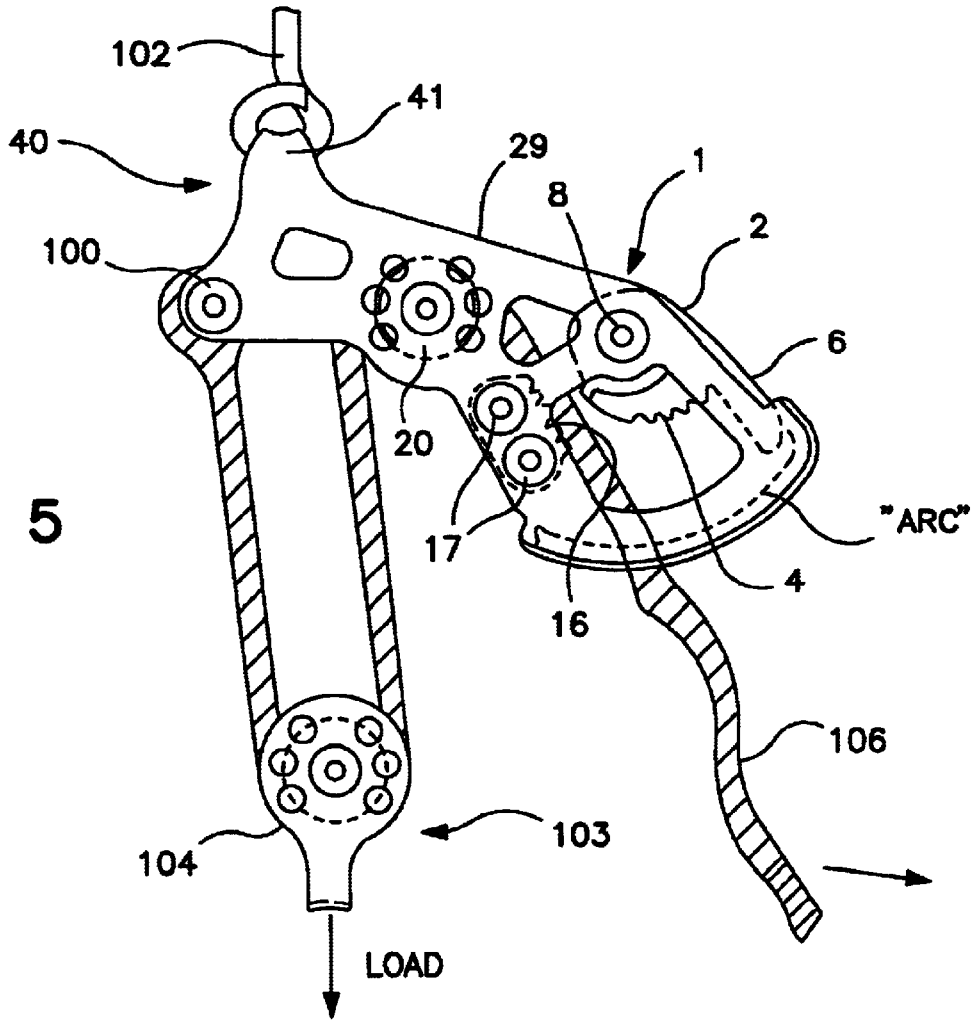
FIG. 5 is a side view, partly in cross section, of a second example embodiment of the lifting device of the invention.

FIG. 5 illustrates a second example embodiment of the lifting device of the invention. This embodiment generally comprises cleat 1, first pulley 20, and base 40 connected to one another by frame member 29. Adjustable cleat 1 comprises rotatable pawl 2 with rope locking surface 4 and arm 6 (shown partially in dotted line). Pawl 2 is rotatable about a pawl hub 8. Adjustable cleat 1 further comprises rope engaging surface 16 substantially opposite to pawl engaging surface 4 when rotatable pawl 2 is in a closed position. Engaging surface 16 may comprise a member as illustrated with a plurality of ridges on its surface held between frame member 29 side cheeks and attached thereto with rivets 17. This example embodiment further comprises becket 100 connected to frame member 29, and load connection means 103 comprising auxiliary pulley 104 connected to a load (not illustrated). Auxiliary pulley 104 generally comprises a sheave rotatable about a central hub with bearing means therebetween.

Base 40 in this second example embodiment comprises a hanging bail 41 for pivotal connection to an overhead surface, such as a ceiling or a beam (not illustrated). To facilitate such connection, this example embodiment may further preferably comprise screw eye 102. It has been discovered that connection to an overhead surface in a pivotal manner as illustrated is advantageous in that it allows for the lifting device of the invention to self adjust and find its static balance point when under load.

Rope 106 passes through cleat 1 between pawl 2 and rope engaging surface 16, rotatably over first pulley 20, rotatably around auxiliary pulley 104, and is finally removably attached to becket 100. "Removably attached" as used herein, describes a condition of being tied, spliced, or otherwise attached in manner such that it may be removed. Removal may occur by untying, cutting, or by other means as may be known.

In operation, the example embodiment of FIG. 5 works in much the same manner as described above with reference to the embodiment of FIGS. 1–4. Rope 106 may be urged against pawl arm 6 to rotate pawl 2 into an open position in which rope 106 may be adjusted through cleat 1. Upon release of rope 106 from urging against arm 6, pawl 2 rotates back into a closed position with rope 106 thereby locked in place between engaging surface 16 and locking surface 4. Pawl 2 preferably has torsion spring means for urging it into a closed position once rope 106 is released.

It will be appreciated by those knowledgeable in the art that the presence of auxiliary pulley 104 significantly increases the lifting power of the second example lifting device embodiment as compared to the first example embodiment illustrated in FIG. 14. It has been discovered that the second example embodiment as illustrated and described herein is a useful design that may be made in a relatively light weight and small size and that is useful for home applications such as providing a lifting device for bicycle storage in a garage or the like.

Figure 6:
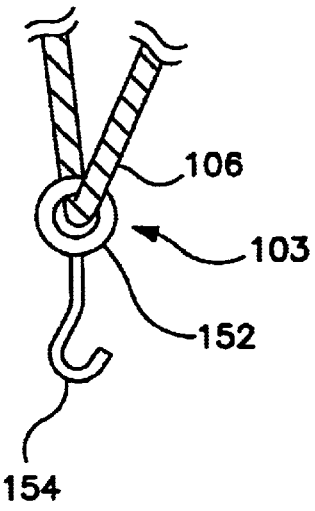
FIG. 6 is a side view of example load attachment means of the lifting device of the invention.

It is further noted that load connection means 103 may comprise a more simple configuration than auxiliary pulley 104. In particular, load connection means 103 are not required to comprise a pulley as illustrated, or for that matter rotatable means at all. As an example, FIG. 6 illustrates load connection means 103 comprising loop 152 with hook 154 for connection to a load. Rope 106 passes movably through loop 152. It will be appreciated that numerous other embodiments of load attachment means are conceivable and are within the scope of the present invention. Generally, these means will comprise at least a member for connecting and movably passing rope 106, and a member for connecting a load. Auxiliary pulley 104 as illustrated in FIG. 5, however, is preferred as it provides additional mechanical advantage.

Frame member 29 preferably comprises opposing sidewalls with first pulley 20, first becket 100, and adjustable cleat 1 held therebetween. Preferred materials of construction for frame member 29 include high strength and low weight polymers. Also, as illustrated in FIG. 5, frame member 29 extends as illustrated to encompass the arc of rotation of pawl arm 6 (illustrated in FIG. 5 as dashed line labeled "ARC"). Preferably, By doing so, rope 106 is advantageously guided along a path where it may be readily urged against pawl arm 6. Further, extension of the frame member 29 in this manner protects pawl arm 6 from interference or exposure to collisions with other objects.

As also illustrated in FIG. 5, pawl 2 is oriented such that urging of rope 106 against pawl arm 6 to rotate pawl 2 into an open position occurs in a direction substantially away from location of the load being lifted. That is, with reference to FIG. 5, rope 106 is drawn in the direction of the arrow to rotate pawl 2 into an open position. This advantageously allows for one using the lifting device to move away from a load being lifted or suspended when adjusting rope 106 for safety considerations.

Figure 7:
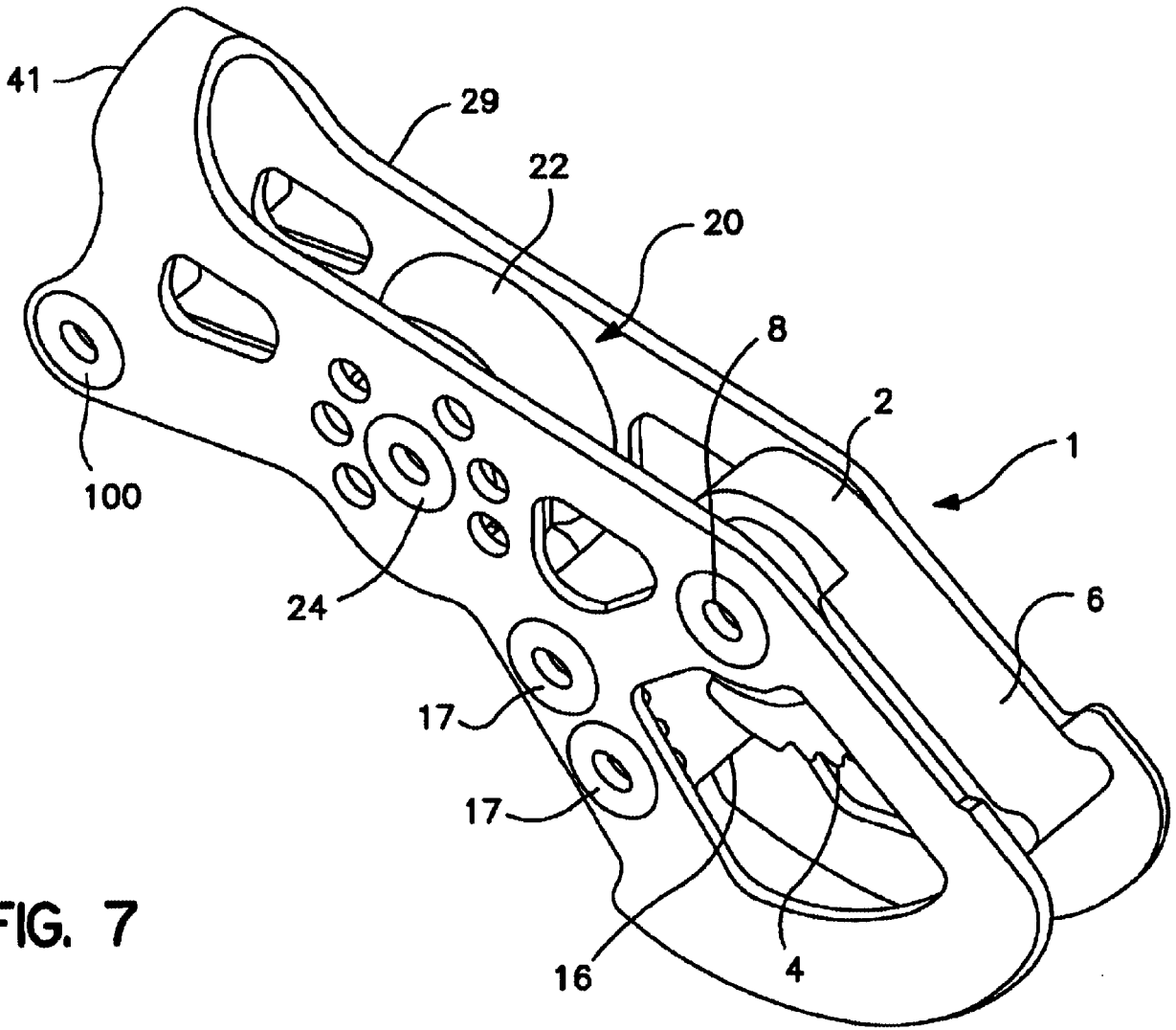
FIG. 7 is a perspective view of the frame, cleat, base, and becket of the second example embodiment of FIG. 5.

FIG. 7 provides a perspective view of the frame member 29, pawl 1, first pulley 20, becket 100, and hanging bail 41 of this second example embodiment.

Figure 8:
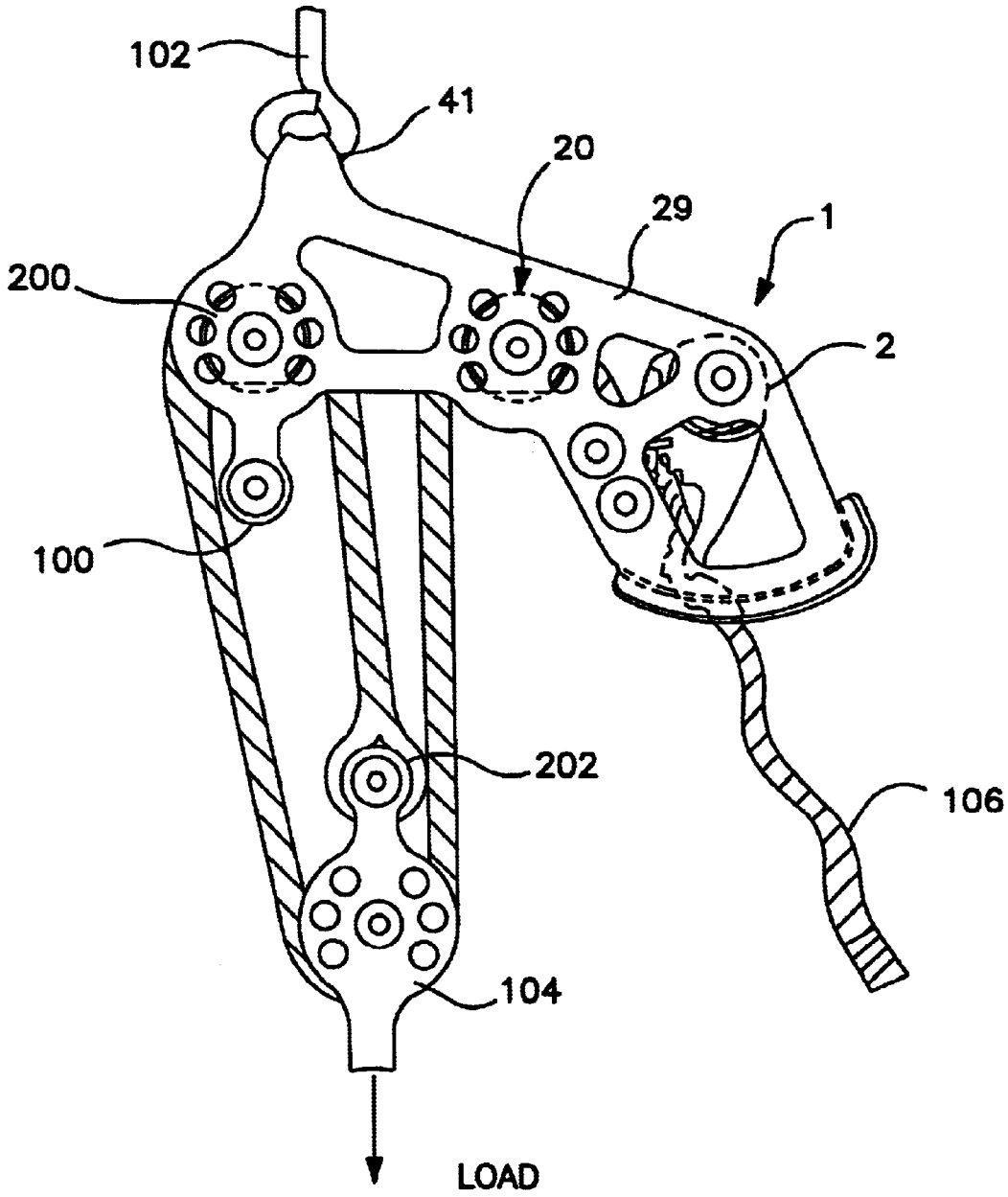
FIG. 8 is a side view of a third example embodiment of the lifting device of the invention.

FIG. 8 is a side view of a third example embodiment of the lifting device of the invention. This third example embodiment is related to the second embodiment as shown in FIGS. 5 and 7 and described above. This third example embodiment generally comprises the elements of the second example embodiment as discussed above. In addition to the elements of the second example embodiment, however, this third example embodiment further comprises second pulley 200 (shown partly in dashed line) attached to frame member 29. Further, auxiliary pulley 104 further comprises auxiliary becket 202 for removably attaching rope 106.

In this third example embodiment, rope 106 preferably adjustably passes through adjustable cleat 1, rotatably over first pulley 20, rotatably about auxiliary pulley 104, rotatably over second pulley 200, and is finally removably attached to auxiliary becket 202. As will be appreciated by those knowledgeable in the art, second pulley 200 provides for additional mechanical lifting advantage over the second example embodiment discussed above.

Figure 9:
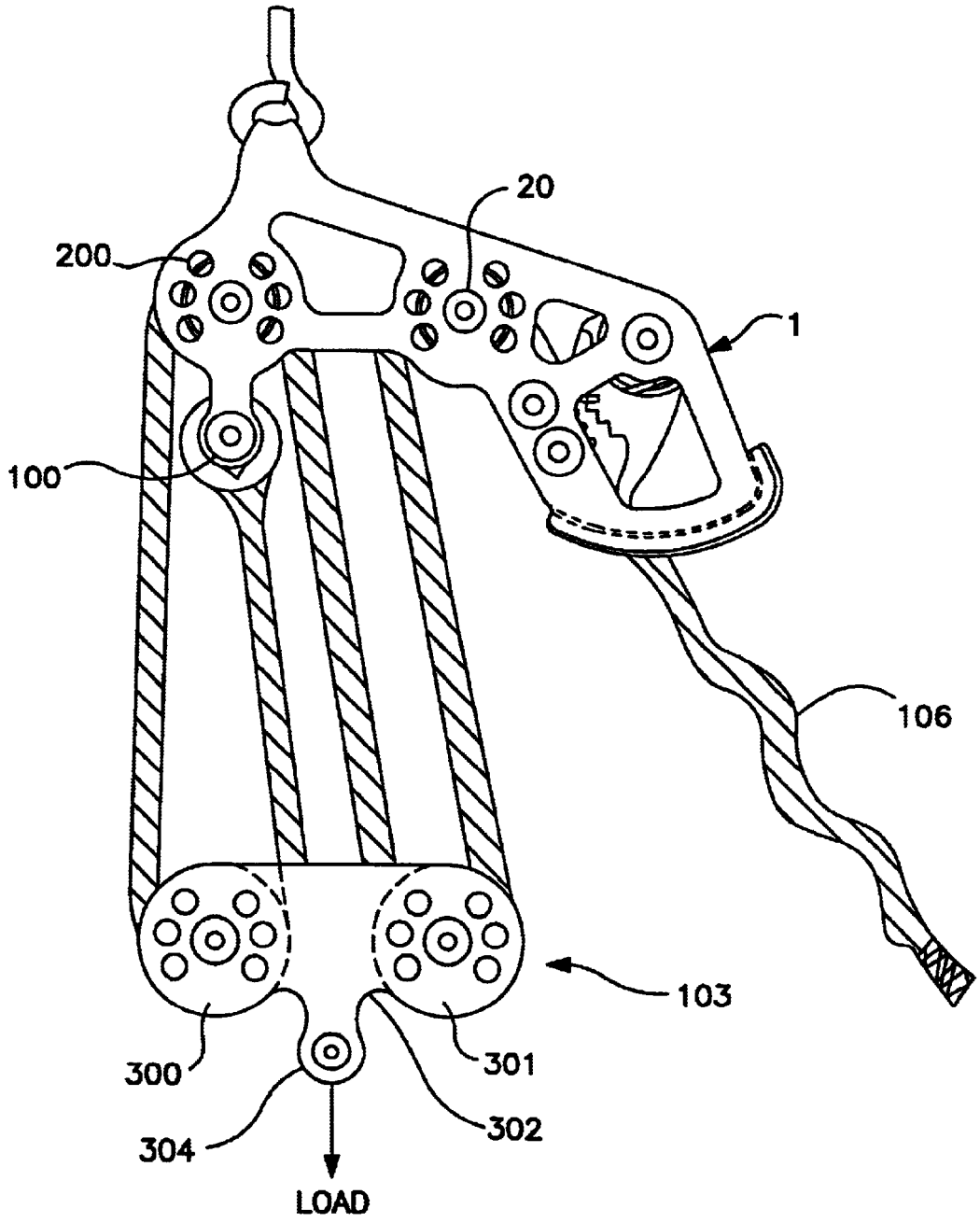
FIG. 9 is a side view of a fourth example embodiment of the lifting device of the invention.

FIG. 9 is a side view of a fourth example embodiment of the lifting device of the invention. As illustrated, it generally comprises the elements of the third example embodiment discussed above, except that load connection means 103 comprise a pair of pulleys 300 and 301 connected by a rigid load connection frame 302. Rope 106 is sheeved through adjustable cleat 1, around first pulley 20, around load connection pulley 301, around second pulley 200, around load connection pulley 300, and finally removably attached to first becket 100.

Load connection pulleys 300 and 301 preferably are substantially identical to one another, and comprise a sheave rotatable about a central hub with bearing means therebetween. Load connection means frame member 302 is rigid and preferably comprises a pair of opposing sidewalls that are integral with respective sidecheeks of pulleys 300 and 301. This fourth example embodiment preferably further comprises load connection becket 304 for connecting to a load. As will be appreciated, numerous replacements for becket 304 may be conceived, with examples comprising a bale or hook.

The fourth example embodiment of FIG. 9 and described above achieves additional mechanical lifting advantage over previously discussed example embodiments due to the presence of an additional pulley. This fourth example embodiment will thereby be of use for heavier lifting duties than other embodiments described herein. As will be appreciated by those knowledgeable in the art, the lifting device of the invention may comprise still additional pulleys for added mechanical lifting advantages.

It will be appreciated that the precise method of sheeving rope 106 through the plurality of pulleys of the various example embodiments of the lifting device of the invention as described herein may be altered to result in a desired mechanical lifting advantage. For example, the third example embodiment shown in FIG. 8 could be used without passing rope 106 about second pulley 200, but instead sheeving rope 106 generally as illustrated in the second example embodiment of FIG. 5. The scope of the invention therefore should not be limited by the method of rope sheeving through the respective pulleys of the lifting device of the invention.

The advantages of the disclosed invention are thus attained in an economical, practical, and facile manner. While example embodiments have been shown and described, it is to be understood that various further modifications and additional configurations will be apparent to those skilled in the art. It is intended that the specific embodiment herein disclosed is illustrative of the preferred and best modes for practicing the invention only, and should not be interpreted as limitations on the scope of the invention as defined by the appended claims.

What is claimed is:

1. A lifting device for raising and lowering an object by means of a rope and pulley, said device comprising frame means for attachment to a support, a cam cleat mounted on the support, said cam cleat comprising a rotatable pawl, a rope engaging surface on said pawl, a u-shaped member attached to the frame means opposite the rope engaging surface of the pawl, said u-shaped member containing said pawl and a rope passing therebetween, a rotatable pulley mounted on the frame spaced from said pawl and u-shaped member, a rope passing around the pulley and led between the pawl and the u-shaped member, an arm attached to said pawl and extending away from said pulley, said rope passing over said arm and being engageable therewith, said arm and said pawl being movable under force of the rope between a rope locking and rope release position with the u-shaped member, spring means acting of said pawl to urge the pawl toward the rope locking position, movement of the rope under tension with said arm causing movement of the pawl in a release position, said spring means acting to automatically return said pawl to a locked position upon release of tension on said rope, thereby providing a safety feature.

2. The listing device of claim 1, wherein said pulley comprises a pair of opposed side cheeks secured to the frame, a central hub secured the side cheeks, a sheave rotatable around the central hub, and bearing means located between said sheave and said central hub.

3. The lifting device of claim 1, wherein the rope when locked by the pawl has a centerline axis, and wherein said pawl is released upon movement away from the centerline axis.

* * * * *